US005725158A

United States Patent [19]

Klaski et al.

[11] Patent Number: 5,725,158

[45] Date of Patent: Mar. 10, 1998

[54] FUEL INJECTION VALVE FOR AN INTERNAL COMBUSTION ENGINE

[75] Inventors: Michael Klaski, Erdmannhausen; Georg Harter, Hemmingen; Harald Walter, Ludwigsburg, all of Germany

[73] Assignee: Robert Bosch GmbH, Stuttgart, Germany

[21] Appl. No.: 589,685

[22] Filed: Jan. 22, 1996

[30] Foreign Application Priority Data

Jan. 31, 1995 [DE] Germany ..... 195 02 915.1

[51] Int. Cl.[6] ..... B05B 1/26; F02M 61/00

[52] U.S. Cl. ..... 239/533.12; 239/522

[58] Field of Search ..... 239/499, 518, 239/521, 522, 524, 533.12, 553.5, 585.1, 590.5

[56] References Cited

U.S. PATENT DOCUMENTS 4,657,189 4/1987 Keine .
4,979,479 12/1990 Furukawa .

FOREIGN PATENT DOCUMENTS 608840 8/1926 France .
3716402 11/1987 Germany .

*Primary Examiner*—Andres Kashnikow
*Assistant Examiner*—Robin O. Evans
*Attorney, Agent, or Firm*—Kenyon & Kenyon

[57] ABSTRACT

A fuel injection valve has a deflection surface which has at least one depression, with the aid of which precisely aligned single, twin or multiple fuel jets can be generated, it being possible to achieve different fuel jet shapes by means of the configuration of the at least one depression. The fuel injection valve is intended, in particular, for mixture-compressing, applied-ignition internal combustion engines.

7 Claims, 6 Drawing Sheets

FUEL INJECTION VALVE FOR AN INTERNAL COMBUSTION ENGINE

FIELD OF THE INVENTION

The present invention pertains to a fuel injection valve for an internal combustion engine.

BACKGROUND INFORMATION

German Patent Application No. 37 16 402 describes a fuel injection valve which has a perforated plate downstream of a metering point for the fuel in order, by means of the perforated plate, to generate a cord-like jet or a plurality of cord-like jets which run inside a deflector sleeve of the fuel injection valve approximately parallel to a valve longitudinal axis of the fuel injection valve and, approximately in the end region of the deflector sleeve, strike an inner ring. The inner ring is made up of individual inner surfaces which slope relative to the valve longitudinal axis and at which the cord-like jets which strike the inner surface are reflected, after which they emerge from a spray opening of the deflector sleeve at an angle to the valve longitudinal axis.

However, an inner ring of this kind must be manufactured with extreme precision and be installed in the deflector sleeve in a precise rotational position since even the smallest deviations can considerably alter the fuel jet pattern and the alignment of the fuel jets. Where the fuel injection valves are mass produced, costly testing operations and, if required, readjustment of the inner ring in the deflector sleeve are therefore necessary, giving rise to considerable production costs.

SUMMARY OF THE INVENTION

The fuel injection valve according to the present invention has the advantage that it is possible in an economical manner to produce fuel injection valves for the generation of a fuel jet or a plurality of fuel jets which is/are precisely aligned, and it is possible in a simple manner to achieve a very wide variety of fuel jet shapes. In particular, it is possible without great expense, in the case of mass production of the fuel injection valves, to guarantee a uniformly precise alignment and shape of the fuel jet, involving, for example, a narrowly confined, widely spread or conical fuel jet.

DETAILED DESCRIPTION OF THE DRAWINGS

Figure 1:
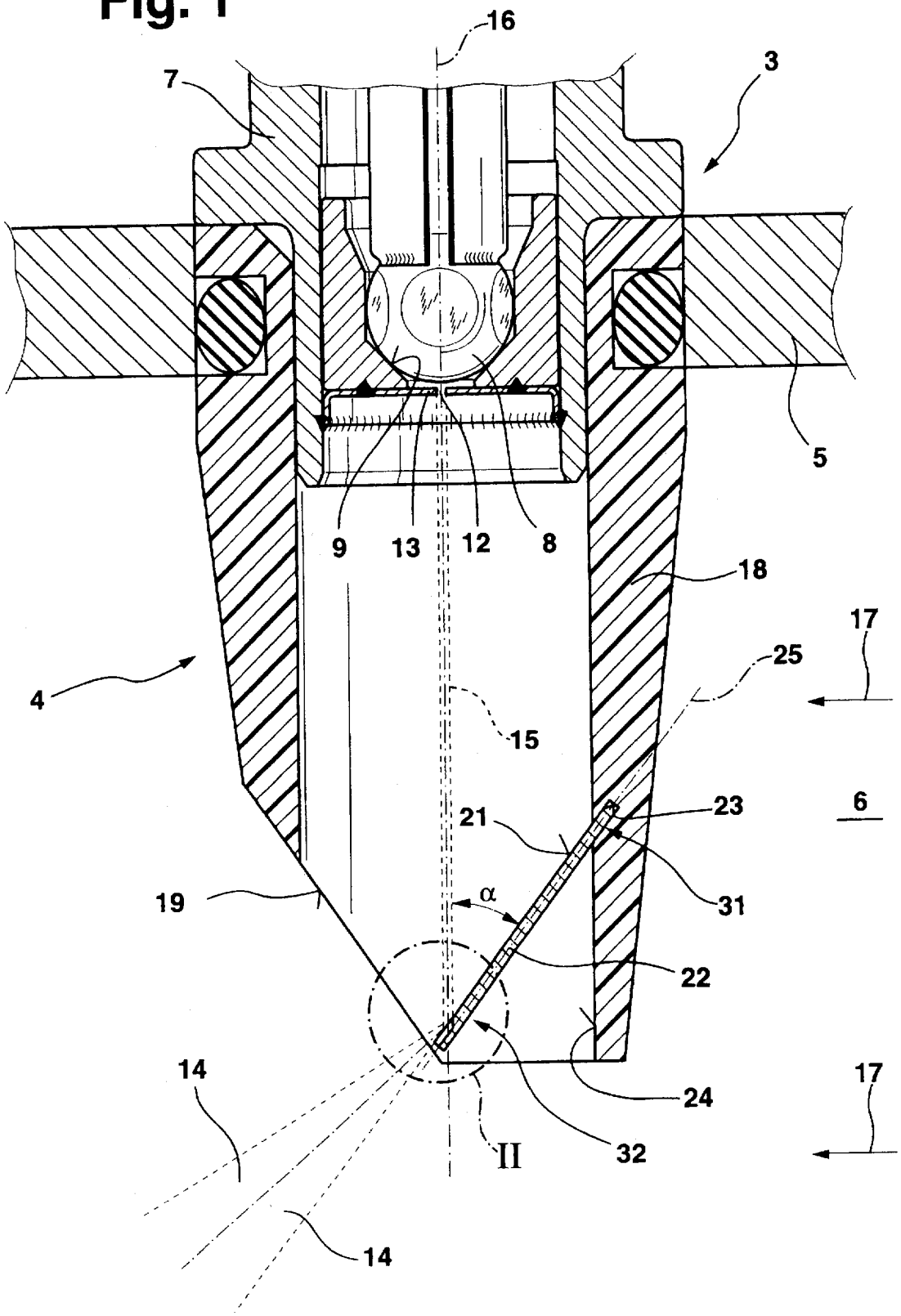
FIG. 1 shows a section through a fuel injection valve in accordance with the present invention.

FIG. 1 shows a section through a fuel injection valve 3, shown only in part, which is intended, in particular, for mixture-compressing, applied-ignition internal combustion engines. The fuel injection valve 3 is attached to an intake pipe 5 of the internal combustion engine by being plugged in, for example. The intake pipe 5 delimits a cross-section of flow 6 in which there flows air drawn in by the internal combustion engine for combustion. The direction of flow of the air drawn in is indicated by corresponding arrows 17 in FIG. 1. The fuel injection valve 3 has a valve housing 7, which is, for example, of electromagnetically actuable design and, at its spray end 4, dispenses the fuel from a spray opening 19 of a deflector sleeve 18 into the cross-section of flow 6. The deflector sleeve 18 has an elongated shape and is attached to the valve housing 7 of the fuel injection valve 3 by, for example, being plugged in, and is produced from plastic, for example.

The fuel leaves the fuel injection valve 3 in the form of a single, twin or multiple fuel jet 14. After a short spray distance, for example, the fuel jet 14 breaks up into very fine fuel droplets and mixes with the air flowing in the intake pipe 5, with the result that as homogeneous a fuel/air mixture as possible is formed which then burns in combustion spaces of the internal combustion engine downstream of an inlet valve (not shown).

According to the present invention, the fuel jet 14 can assume different fuel jet patterns, for example a narrowly confined, widely spread or conical fuel jet pattern. The fuel jet 14 is generally directed at the inlet valve (not shown) of the internal combustion engine. The fuel is preferably dispensed approximately into the center of the cross-section of flow 6 delimited by the intake pipe 5. Dispensing the fuel approximately into the center of the cross-section of flow 6 prevents the formation of a wall film of fuel which would interfere with combustion, a film that would otherwise settle particularly on walls of the intake pipe 5 and on the inlet valve.

The fuel is metered in a known manner in the interior of the fuel injection valve 3 by a valve-closing element or a valve-closing needle and a valve seat. In the exemplary embodiment, the valve-closing element is formed by a valve-closing ball 8 which, in the closed position, rests on a valve seat 9 of, for example, conical design so as to shut off the fuel flow to a metering opening 12 situated downstream of the valve seat 9. In the open position, the valve-closing ball 8 is raised from the valve seat 9, with the result that fuel flows out of the metering opening 12. The metering opening 12 is, for example, formed in what is referred to as a perforated spray disc 13. The fuel leaves the metering opening 12 in concentrated form in the form of a cord-like jet 15 which extends through the interior of the deflector sleeve 18, in the direction of a valve longitudinal axis 16 of the fuel injection valve 3 for example. The metering opening 12 here lies coaxially to the valve longitudinal axis 16. However, it is also possible for a plurality of metering openings 12 to be provided in the perforated spray disc 13.

Approximately in the end region of the deflector sleeve 18, the cord-like jet 15 strikes a deflection surface 21 formed by one surface of, for example, a thin rectangular deflector plate 22. The deflector plate 22 is, for example, manufactured as a metal stamping and, at a short side face, is inserted and held at a fixing end 31, in a groove 23, for example which is provided in an inner wall 24 of the deflector sleeve 18, for example in the end region of the spray opening 19. In the installed state of the deflector plate 22, the deflection surface 21 faces the valve seat 9 and its side facing the groove 21 encloses with the valve longitudinal axis 16 an angle of incidence α which is greater than zero and less than 90 degrees. The angle of incidence α of the deflector plate 22 is preferably in a range of about 30 degrees to 60 degrees. The angle of incidence α and the distance between the metering opening 12 and the deflector plate 22 is chosen in such a way that at least one fuel jet 14 is generated, this emerging from the deflector sleeve 18 in the middle of the cross-section of flow 6, for example, and directed at an inlet valve or a plurality of inlet valves of the internal combustion engine.

The cord-like jet 15 strikes the deflector plate 22 in the region of a free plate end 32 bounded in FIG. 1 by a line II illustrated by chain-dotted lines and leaves the plate essentially parallel to the deflection surface 21 of the deflector plate 22, reflection of the cord-like jet 15 at the deflector plate 22 being very largely avoided. The direction of the at least one fuel jet 14 leaving the deflector plate 22 can be varied within extremely wide limits by means of the setting of the deflector plate 22 or a change in the angle of incidence α giving rise to the possibility of a very wide variety of installation positions and installation locations on the intake pipe 5 for the fuel injection valve 3. As illustrated in FIG. 1, the fuel injection valve 3 can, for example, be installed in the intake pipe at right angles to the direction of flow 17.

The at least one fuel jet 14 leaves the fuel injection valve 3 from the spray opening 19 essentially at the angle of incidence a of the deflector plate 22 and is thus at an oblique angle relative to the valve longitudinal axis 16 and relative to the direction of flow 17 in the intake pipe 5 in order, for example, to direct it at an inlet valve of the internal combustion engine. However, it is also possible to install the fuel injection valve 3 at an oblique angle to the direction of flow 17 in the intake pipe 5, so that a smaller angle of incidence α of the deflector plate 22 is required to dispense the at least one fuel jet 14 in the direction of the inlet valve. The oblique position of the fuel injection valve 3 furthermore results in a shorter distance between the at least one fuel jet 14 and the inlet valve, thereby avoiding condensation of fuel on cold walls, especially on walls of the intake pipe 5 and of the inlet valve.

Figure 3:
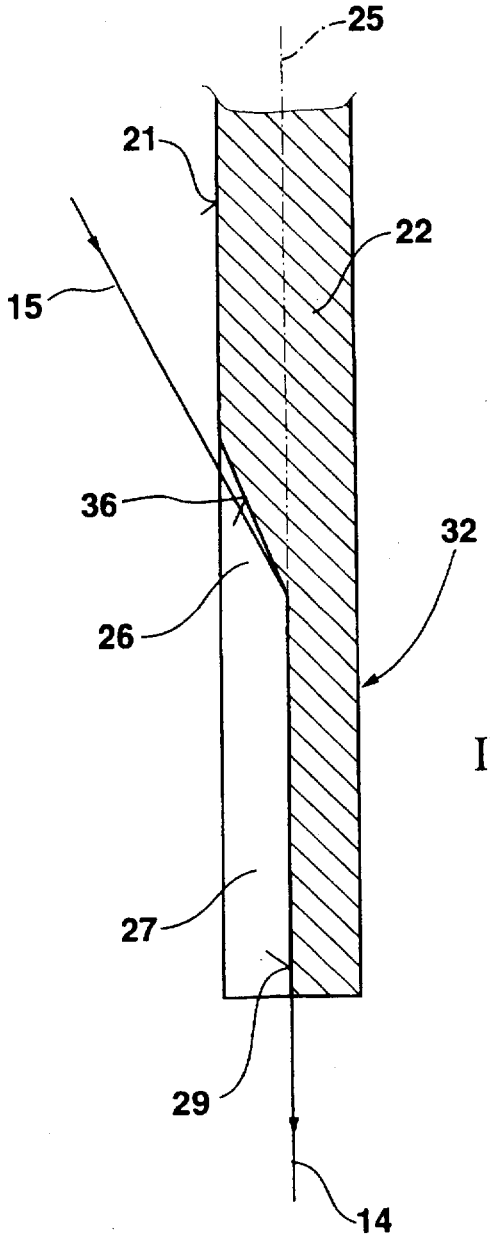
FIG. 3 shows a side view of a section along the line III—III in FIG. 2.
Figure 2:
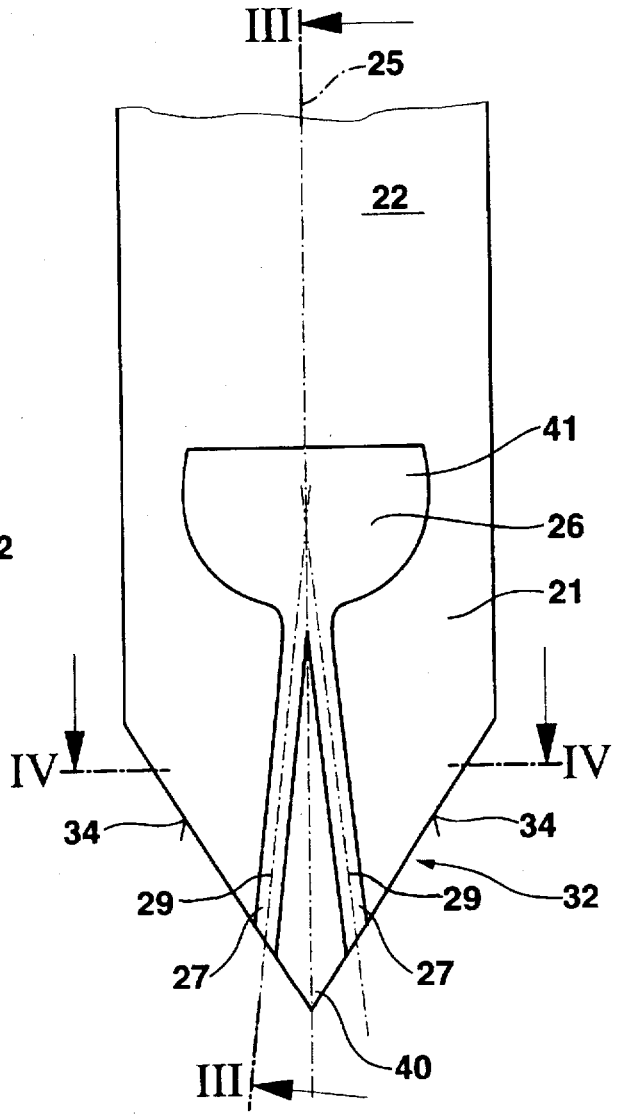
FIG. 2 shows a plan view of a first exemplary embodiment of a deflector plate in accordance with the present invention.
Figure 4:
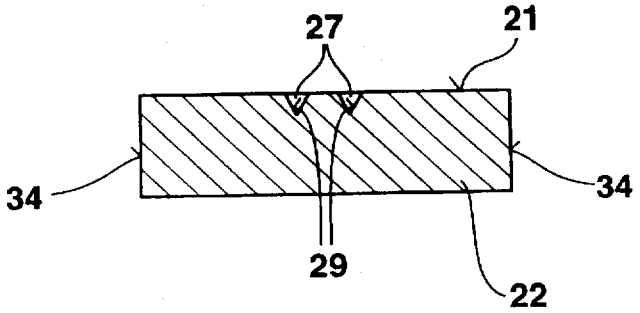
FIG. 4 shows a section along the line IV—IV in FIG. 3.

The cord-like jet 15 striking the deflection surface 21 leaves the cord-like jet 15 essentially parallel to the deflection surface 21 of the deflector plate 22 in the direction of a plate longitudinal axis 25 symmetrically dividing the deflection surface 21. In order to accomplish this without reflection of the cord-like jet 15, depressions 26, 27 designed in accordance with the present invention are provided in the deflection surface 21 in the region of impact of the cord-like jet 15 and, as illustrated in FIGS. 2 to 4, these depressions are recessed into the deflection surface 21 of the deflector plate 22. The shape of the depressions 26, 27 can be used to influence the shape of the at least one fuel jet 14 leaving the deflector plate 22 so as, for example, to give rise to single, twin or multiple fuel jets 14 that leave the deflector plate 22 with fuel-jet shapes predeterminable by the depressions 26, 27. Thus, it is possible, for example, to generate one fuel jet 14 or a plurality of fuel jets 14 that have narrowly confined, widely spread or conical fuel jet patterns, the fuel breaking up into very fine fuel droplets after a certain spraying distance, for example.

FIG. 1 shows a first exemplary embodiment according to the present invention of the deflector plate 22 illustrated only in part in FIG. 2. The depressions 26, 27 serve, on the one hand, to divert the single impinging cord-like jet 15 essentially in the direction of the plate longitudinal axis 25 and, on the other hand, to split the cord-like jet 15 into, for example, two individual fuel jets 14. The depression 26, which is referred to more specifically below as receiving depression 26, is recessed into the deflection surface 21 in the form of a hollow. The hollow has, for example, an approximately semicircular impact cross-section 41, which is divided symmetrically by the plate longitudinal axis 25. The plate longitudinal axis 25 likewise encloses the angle of incidence α with the valve longitudinal axis 16 of the fuel injection valve 3. The receiving depression 26 is connected to two further depressions 27, referred to more specifically below as outflow depressions 27. The outflow depressions 27 are recessed into the deflection surface 21 in the form of channels which extend from the receiving depression 26 to the free plate end 32, spreading apart as they do so. The free plate end 32 has a pointed end 40, which is formed, for example, by two tapering plate side faces 34 and, for example, lies on the plate longitudinal axis 25.

Attention is drawn to the fact that the invention is not limited to a plate end 32 of pointed design. On the contrary, the plate end can take an extremely wide variety of forms, it being possible by means of the design of the plate end 32 to achieve an extremely wide variety of fuel jet shapes. A pointed plate end 32 is suitable, in particular, for twin fuel jets. However, it is also possible to make the free plate end 32 blunt, for example with a plate end 32 running at right angles, perpendicular to the valve longitudinal axis 16, in order, for example, to generate a single fuel jet.

As illustrated in FIG. 3, a sectional representation along a line III—III in FIG. 2, the cord-like jet 15 dispensed in the fuel injection valve 5 from the metering opening 12 first of all strikes the receiving depression 26 within the deflector sleeve 18, collects in the receiving depression 26 and then flows onwards in the outflow depressions 27 in the direction of the free plate end 32, and finally, at the plate end 32, flows off via the plate side faces 34. In order as far as possible to avoid reflection of the cord-like jet 15 when the cord-like jet 15 strikes the receiving depression 26, the receiving depression 26 has a beveled bottom 36 which slopes approximately in the direction of the cord-like jet 15 striking the receiving depression 26.

At the downstream end, in the direction of the free plate end 32, the bottom 36 of the receiving depression 26 merges into the bottoms 29 of the outflow depressions 27, which lead with a constant depth to the plate end 32 in order to guide the fuel collected in the receiving depression 26 away via the outflow depressions 27 with as little hindrance to flow as possible. From the outflow depressions 27, the fuel flows off via the free plate end 32, the direction of the at least one fuel jet 14 formed being determined by the directions of the outflow depressions 27, so that a twin fuel jet 14 is generated by means of the two outflow depressions 27. By means of the configuration of the receiving depression 26, it is advantageously possible to compensate for differences in the impact of the cord-like jet 15 due, for example, to eccentricity between the metering opening 12 and the receiving depression 26 resulting from manufacturing tolerances of the metering opening 12, and the alignment and shape of the at least one fuel jet 14 is thus always uniformly precise.

As illustrated in FIG. 4, a side view of a section along a line IV—IV in FIG. 3, the outflow depressions 27 have bottoms 29 with, for example, a triangular cross section. However, it is also possible to design the bottoms 29 with a semicircular or U-shaped cross section. By means of the cross-sectional configuration of the bottom 29 of the outflow depressions 27, the degree of the spread of the outflow depressions 27 in the direction of the plate end 32, and the design of the free plate end 32, it is possible to generate at least one fuel jet 14 with a different fuel jet pattern, for example with a narrowly confined, a widely spread or a conical fuel jet pattern.

Figure 5:
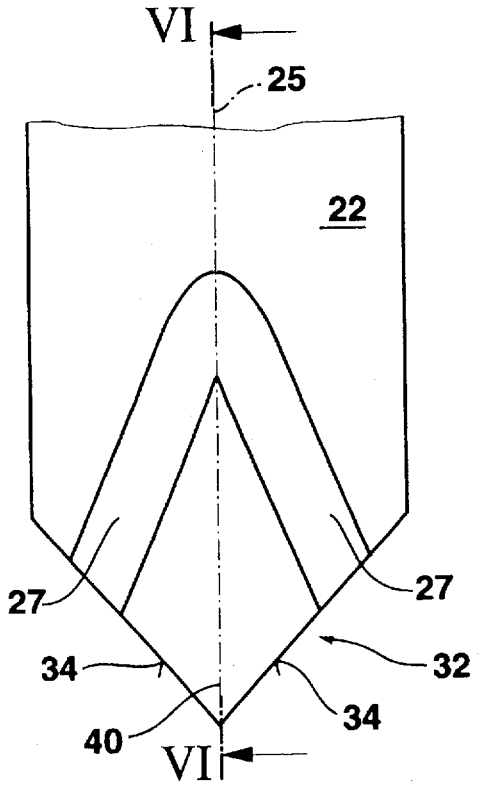
FIG. 5 shows a plan view of a second exemplary embodiment of the deflector plate in accordance with the present invention.

FIG. 5 shows a plan view of the deflector plate 22 in accordance with a second exemplary embodiment according to the present invention, in which all those parts which are the same or have the same action are denoted by the same reference numerals as in the first exemplary embodiment in accordance with FIGS. 1 to 4. As in the first exemplary embodiment, the cord-like jet 15 which strikes the deflector plate 22 is divided into two individual fuel jets 14. In contrast to the first exemplary embodiment, the deflector plate 22 does not have a receiving depression 26 for this purpose but just two outflow depressions 27, which open into one another in the region of impact of the cord-like jet 15 and spread apart in the direction of the free plate end 32, in the form of the sides of a triangle.

Figure 6:
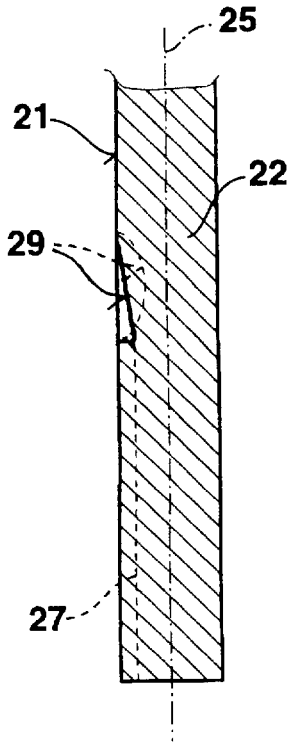
FIG. 6 shows a side view of a section along the line VI—VI in FIG. 5.

As illustrated in FIG. 6, a side view of a section along a line VI—VI in FIG. 5, the bottom 29 is likewise designed to slope in the direction of the impinging cord-like jet 15 in the region of impact of the cord-like jet 15 in order to divert the cord-like jet 15 into the outflow depressions 27 without hindering flow as far as possible, reflection of the cord-like jet 15 thus being very largely avoided. As illustrated in broken lines in FIG. 6, it is also possible to make the bottom 29 trough-shaped in the region of impact of the cord-like jet 15, for example in the form of a hemispherical shell.

Figure 7:
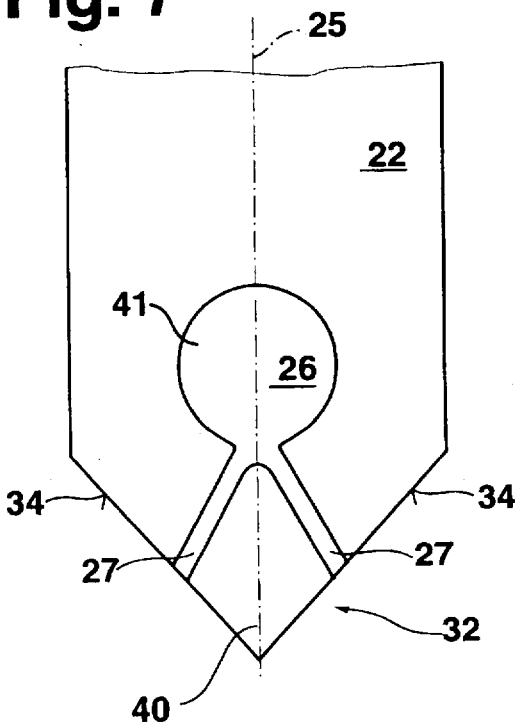
FIG. 7 shows a plan view of a third exemplary embodiment of a deflector plate in accordance with the present invention.

FIG. 7 shows, in a plan view, a third exemplary embodiment according to the present invention of the deflector plate 22, in which all those parts which are the same or have the same action are denoted by the same reference numerals as in the preceding exemplary embodiments in accordance with FIGS. 1 to 6. As illustrated in FIG. 7, the receiving depression 26 can also have a circular impact cross section 41 into which, once again, there open two outflow openings 27 which spread apart in the direction of the free plate end 32.

Figure 8:
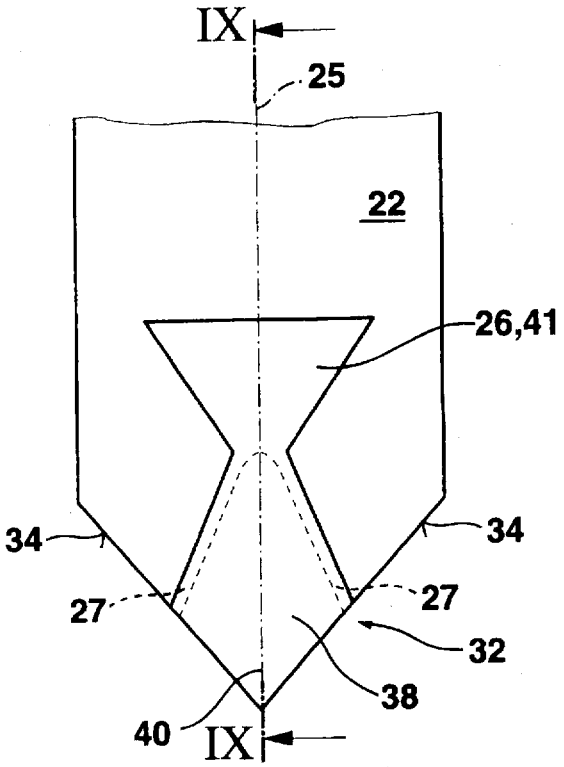
FIG. 8 shows a plan view of a fourth exemplary embodiment of a deflector plate in accordance with the present invention.

FIG. 8 shows, in a plan view, a fourth exemplary embodiment according to the invention of the deflector plate 22, in which all those parts which are the same or have the same action are denoted by the same reference numerals as in the preceding exemplary embodiment in accordance with FIGS. 1 to 7. As illustrated in FIG. 8, the receiving depression 26 can also have a triangular impact cross section 41, into which, once again, there open two outflow depressions 27 which, as illustrated in broken lines in FIG. 8, likewise spread apart in the direction of the free plate end 32 in order to generate twin fuel jets 14. The triangular impact cross section 41 tapers in the direction of the free plate end 32. To generate a fuel jet 14 which leaves the deflector plate 22 as a single jet, it is possible to omit the outflow depressions 27 or to replace them by a diamondshaped step 38 of, for example, constant depth. The fuel of the cord-like jet 15 striking the receiving depression 26 is here diverted via the receiving depression 26, along the step 38 to the plate end 32, after which the fuel flows off via the sharp end 40 over a partial area of the plate end 32.

Figure 9:
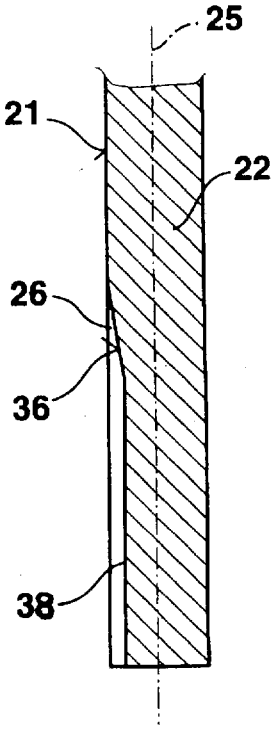
FIG. 9 shows a side view of a section along the line IX—IX in FIG. 8.

As illustrated in FIG. 9, a side view along a line IX—IX in FIG. 8, the receiving depression 26 likewise has a beveled bottom 36 which is pitched in the direction of the impinging cord-like jet 15 in order very largely to avoid deflection of the cordlike jet 15 and divert the latter in the direction of the step 38.

Figure 10:
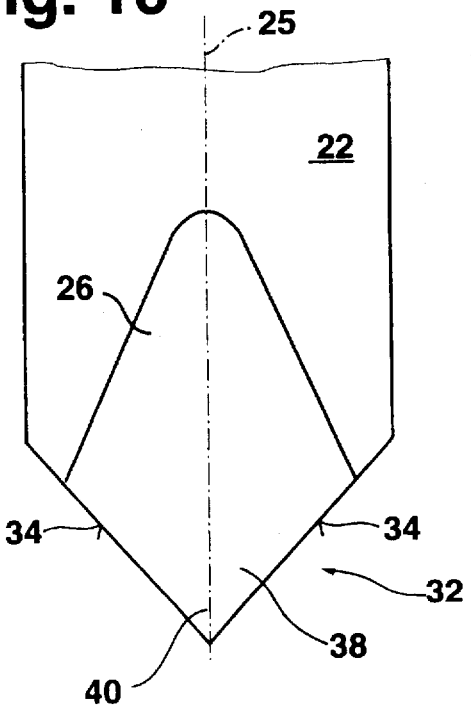
FIG. 10 shows a plan view of a fifth exemplary embodiment of a deflector plate in accordance with the present invention.

FIG. 10 shows, in a plan view, a fifth exemplary embodiment according to the present invention of the deflector plate 22, in which all those parts which are the same or have the same action are denoted by the same reference numerals as in the preceding exemplary embodiments in accordance with FIGS. 1 to 9. As illustrated in FIG. 10, the receiving depression 26 with the step 38 in accordance with FIG. 8 can also have the external shape of a quill in order to generate a single fuel jet 14. Here, the fuel flows off via the sharp end 40 of the step 38. However, it is also possible to make the end 40 blunt, for example, with a plate side face 34 which extends at right angles through the plate longitudinal axis 25.

Figure 11:
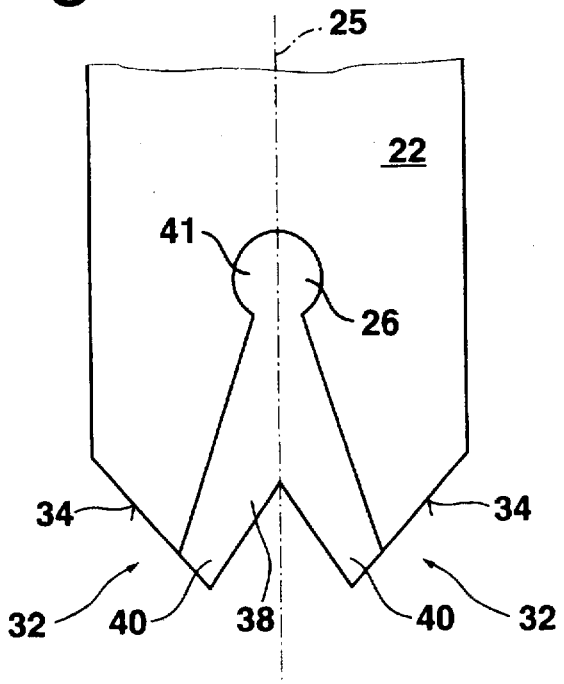
FIG. 11 shows a plan view of a sixth exemplary embodiment of a deflector plate in accordance with the present invention.

FIG. 11 shows, in a plan view, a sixth exemplary embodiment according to the present invention of the deflector plate 22, in which all those parts which are the same or have the same action are denoted by the same reference numerals as in the preceding exemplary embodiments in accordance with FIGS. 1 to 10. As illustrated in FIG. 11, the free plate end 32 with the plate side faces 34 can also have a jagged shape where, for example, respective sharp ends 40 are provided on the left and right, symmetrically with respect to the plate longitudinal axis 25, so that the free plate end 32 assumes a W shape. The receiving depression 26 has a circular impact cross section 41 and makes a transition from this into the step 38 in order, in accordance with the fourth exemplary embodiment, to generate a single fuel jet 14.

Figure 13:
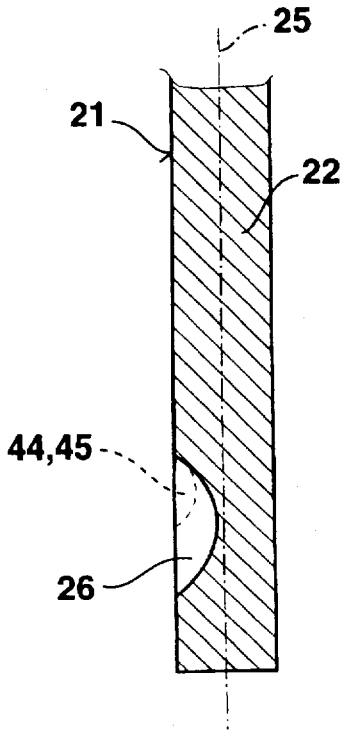
FIG. 13 shows a side view of a section along the line XIII—XIII in FIG. 12.
Figure 12:
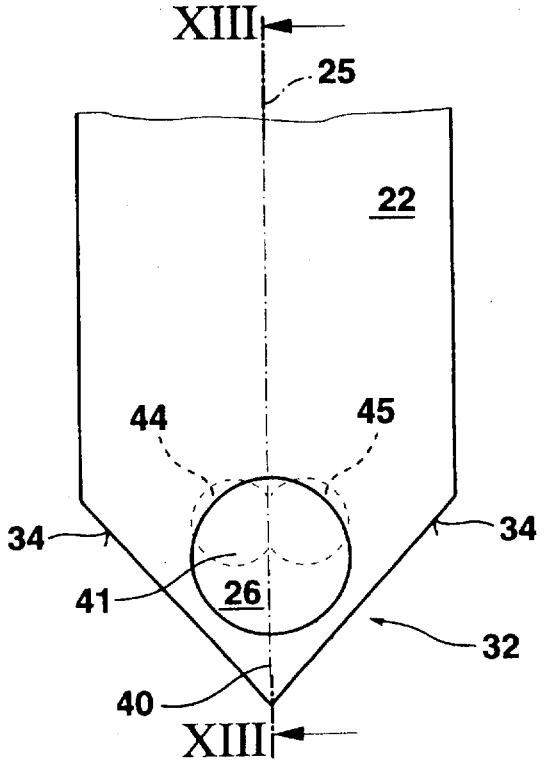
FIG. 12 shows a plan view of a seventh exemplary embodiment of a deflector plate in accordance with the present invention.

FIG. 12 shows, in a plan view, a seventh exemplary embodiment according to the present invention of the deflector plate 22, in which all those parts which are the same or have the same action are denoted by the same reference numerals as in the preceding exemplary embodiments in accordance with FIGS. 1 to 11. As illustrated in FIG. 12, it is also possible to dispense completely with the outflow depressions 27 and to use a receiving depression 26 alone. As shown in FIG. 13, a side view of a section along a line XIII—XIII in FIG. 12, the receiving depression 26 can for this purpose have, for example, an inner surface which corresponds to the outer surface of a hemispherical shell in order to generate a single fuel jet 14 upon impingement of the cord-like jet 15 on the receiving depression 26. As illustrated in FIGS. 12 and 13 in broken lines, the receiving depression 26 can also be made up of two individual circular part-troughs 44, 45 which merge into one another at the plate longitudinal axis 25 and form the impact cross section 41 in the form of a recumbent eight in order to generate a twin fuel jet 14.

Figure 14:
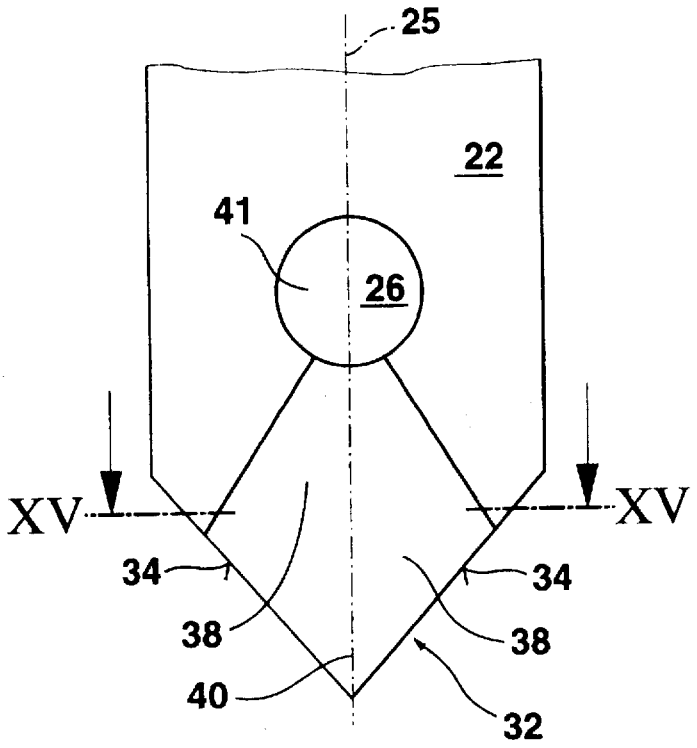
FIG. 14 shows a plan view of an eighth exemplary embodiment of a deflector plate in accordance with the present invention.
Figure 15:
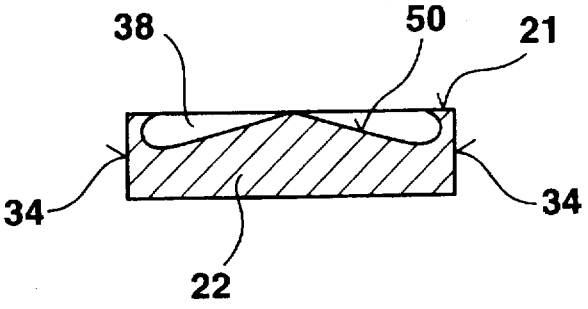
FIG. 15 shows a section along the line XV—XV in FIG. 14.

FIG. 14 shows, in a plan view, an eighth exemplary embodiment according to the present invention of the deflector plate 22, in which all those parts which are the same or have the same action are denoted by the same reference numerals as in the preceding exemplary embodiments in accordance with FIGS. 1 to 13. As illustrated in FIG. 14, the receiving depression 26 can, in accordance with the third exemplary embodiment shown in FIG. 7, have a circular impact cross section 41 for example. Instead of the channel-shaped outflow depressions 27, a diamond-shaped step 38 can be provided, extending from the receiving depression 26 to the plate end 32, for example with a constant depth. As illustrated in FIG. 15, a sectional representation of a section XV—XV in FIG. 14, the step 38 can also have a curved bottom 50 which deepens towards the plate side faces 34 in order to generate by means of the receiving depression 26 and the step 38 a twin fuel jet 14.

What is claimed is:

1. A fuel injection valve for an internal combustion engine, the valve having a longitudinal axis and having at least one metering opening from which fuel emerges in the form of a cord-like jet, the valve comprising:

a deflecting surface disposed in an interior portion of the valve, the deflecting surface having at least one of a receiving depression and an outflow depression for deflecting and shaping the fuel jet, the deflecting surface being disposed such that the fuel strikes the deflecting surface and subsequently emerges from the valve obliquely to the valve longitudinal axis.

2. The fuel injection valve according to claim 1, wherein the deflecting surface is formed by a top surface of a deflector plate.

3. The fuel injection valve according to claim 2, wherein the deflector plate has a pointed end, fuel leaving the deflector plate via the pointed end.

4. The fuel injection valve according to claim 2, wherein the receiving depression is recessed into the deflector surface of the deflector plate in the form of a trough.

5. The fuel injection valve according to claim 2, wherein the outflow depression is recessed into the deflector surface of the deflector plate in the form of a channel, the channel extending as far as a free plate end.

6. The fuel injection valve according to claim 4, wherein the receiving depression is connected to two outflow depressions recessed into the deflector surface of the deflection plate in the form of a channel, the channel extending as far as a free plate end.

7. The fuel injection valve according to claim 4, wherein the receiving depression has a beveled bottom.

* * * * *